US010351149B2

(12) United States Patent
Lanigan, Sr. et al.

(10) Patent No.: US 10,351,149 B2
(45) Date of Patent: Jul. 16, 2019

(54) RAIL CAR LIFTING DEVICE

(71) Applicant: Mi-Jack Products, Inc., Hazel Crest, IL (US)

(72) Inventors: John J. Lanigan, Sr., Orland Park, IL (US); Martin C. Conneally, Downers Grove, IL (US); Antonio Carlos Callado Souza, Chicago, IL (US); Jason Schmidt, Flossmoor, IL (US)

(73) Assignee: Mi-Jack Products, Inc., Hazel Crest, IL (US)

( * ) Notice: Subject to any disclaimer, the term of this patent is extended or adjusted under 35 U.S.C. 154(b) by 450 days.

(21) Appl. No.: 15/087,325

(22) Filed: Mar. 31, 2016

(65) Prior Publication Data

US 2017/0282941 A1 Oct. 5, 2017

(51) Int. Cl.
*B61K 5/00* (2006.01)
*B66F 7/06* (2006.01)

(52) U.S. Cl.
CPC ..... *B61K 5/00* (2013.01); *B66F 7/0633* (2013.01)

(58) Field of Classification Search
CPC ..... B61K 5/00; B61K 5/04; B66F 7/06; B66F 7/0633; B66F 7/0641; B66F 7/08
See application file for complete search history.

(56) References Cited

U.S. PATENT DOCUMENTS 2,369,838 A * 2/1945 Minnis ..... B62B 3/0612 254/2 B
3,096,895 A * 7/1963 Kappen ..... B61J 1/10 187/234
3,305,047 A * 2/1967 Bronder ..... B61K 5/04 212/299
3,432,006 A * 3/1969 Senger ..... B66F 7/0641 187/203
3,843,092 A * 10/1974 Oehler ..... B60P 1/02 254/2 R
3,865,347 A * 2/1975 Pase ..... B61D 7/32 254/124
4,068,823 A * 1/1978 Belanger ..... B66F 3/24 254/89 H
4,548,387 A * 10/1985 Saccoccia ..... B66F 7/0625 254/10 B
4,805,875 A * 2/1989 Jackson ..... B66F 3/24 254/2 R
5,133,531 A * 7/1992 Grashoff ..... B61K 5/04 254/89 H
5,372,353 A * 12/1994 West ..... B25H 1/0007 254/10 B
5,876,018 A * 3/1999 Crisp ..... B61K 5/04 254/124

(Continued)

*Primary Examiner* — Tyrone V Hall, Jr.

(74) *Attorney, Agent, or Firm* — McCracken & Gillen LLC

(57) ABSTRACT

A lifting device for lifting a rail car includes a frame with a load plate movably disposed thereon and a back plate movably disposed on the frame and coupled to the load plate. The lifting device further includes a first actuator disposed on the frame and operatively coupled to the back plate and at least one second actuator operatively coupled to the load plate such that the first actuator and the at least one second actuator produce forces in first and second directions. Further still, the first actuator and the at least one second actuator move the load plate of the lifting device in a substantially vertical direction.

14 Claims, 17 Drawing Sheets

(56) References Cited

U.S. PATENT DOCUMENTS

| | | | | |
|---|---|---|---|---|
| 6,966,542 | B2 * | 11/2005 | Bettencourt | B25H 1/0014 254/120 |
| 7,267,057 | B2 * | 9/2007 | Shah | B61K 5/00 104/32.1 |
| 8,469,338 | B2 * | 6/2013 | Gann | B66F 3/22 254/1 |
| 2002/0121632 | A1 * | 9/2002 | Siglock | B66F 5/04 254/133 R |
| 2004/0007697 | A1 * | 1/2004 | Petrone | B66F 7/0625 254/10 B |

* cited by examiner 106
174
172b
176
130a
130b
116b
116a
184b
184a
170
170
104
168a
178a
186a
180a
112

RAIL CAR LIFTING DEVICE

CROSS REFERENCE TO RELATED APPLICATIONS

Not applicable

REFERENCE REGARDING FEDERALLY SPONSORED RESEARCH OR DEVELOPMENT

Not applicable

SEQUENTIAL LISTING

Not applicable

FIELD OF THE DISCLOSURE

The present subject matter relates to lifting devices, and more particularly, to a lifting device used to raise a rail car.

BACKGROUND

The vast majority of freight in the United States travels by rail car. Increasingly, more and more of the freight shipped by rail cars travels in intermodal containers. These intermodal containers are carried on rail cars that roll on wheel and axle assemblies. As with automobile tires, the wheel and axle assemblies on rail cars must be periodically replaced due to wear or damage incurred while in transit.

Unlike the changing of an automobile tire, the changing of a rail car wheel and axle assembly may be a difficult and time-consuming process that may require the use of several pieces of machinery. Given the size and weight of the equipment involved, it may also present dangers to personnel and equipment performing the maintenance.

Conventional wheel changing is accomplished using wheel trucks that employ jacks and a crane to lift the rail car. The process may also be performed using sidewinder vehicles that are similar to a front-end loader with a boom on one side and a counterweight on the side opposite the boom. Such an operation requires one sidewinder to be positioned on each side of the rail car so that the respective boom of each vehicle may be hooked to the rail car through the use of chains placed on the car. The booms then lift and suspend the car while work crews roll the old wheel out from under the rail car and replace it by rolling a new wheel into position. This evolution requires several heavy pieces of equipment and numerous support personnel to carry out the task of changing the wheel.

A device that would allow for the lifting of a rail car and facilitate the changing of a wheel and axle assembly using a limited number of people and pieces of equipment would be an improvement in the art.

SUMMARY

According to one aspect, a lifting device for lifting a rail car includes a frame with a load plate movably disposed thereon and a back plate movably disposed on the frame and coupled to the load plate. The lifting device further includes a first actuator disposed on the frame and operatively coupled to the back plate and at least one second actuator operatively coupled to the load plate such that the first actuator and the at least one second actuator produce forces in first and second directions. Further still, the first actuator and the at least one second actuator move the load plate of the lifting device in a substantially vertical direction.

According to another aspect, a method of lifting a rail car includes arranging a lifting device across a rail way such that a rail car is above the lifting device. The lifting device used in the method includes a frame with a load plate movably disposed thereon and a back plate is movably disposed on the frame and coupled to the load plate. The method further includes raising the rail car through moving the load plate vertically by activating a first actuator disposed on the frame and operatively coupled to the back plate such that the first actuator produces a force in a first direction, and activating at least one second actuator operatively coupled to the load plate such that the at least one second actuator produces a force in a second direction transverse to the first direction. Further still in the method, the first actuator and the at least one second actuator operate together to move the load plate vertically.

Other aspects and advantages of the present invention will become apparent upon consideration of the following detailed description and the attached drawings wherein like numerals designate like structures throughout the specification.

DETAILED DESCRIPTION

As shown in FIGS. 1, 2, 4, 5, 6, 7, 10, 11, and 12 disclosed is a lifting device 100 for lifting or partially lifting rail cars.

Figure 1:
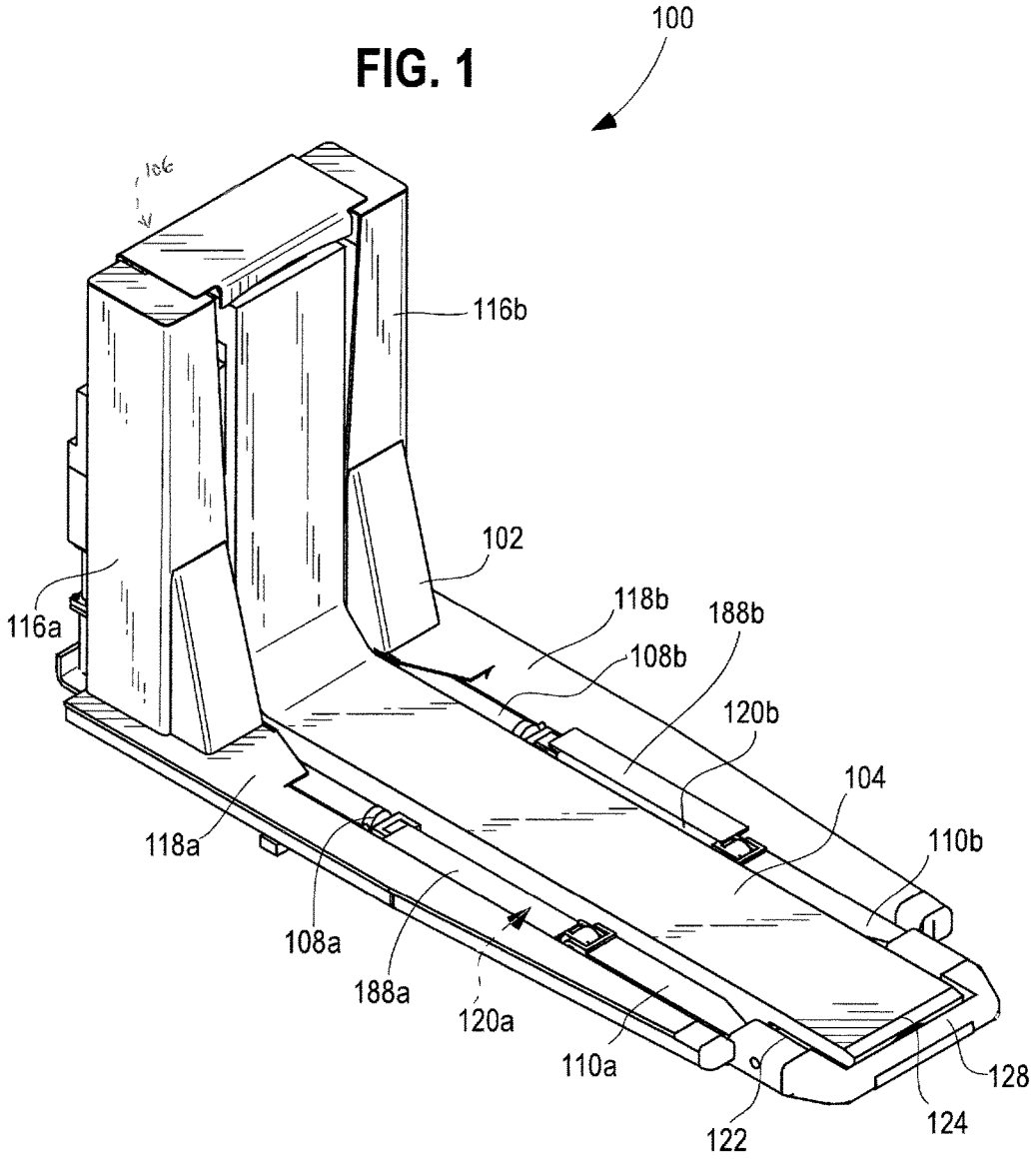
FIG. 1 is an isometric front view of a lifting device in a retracted position.

Referring now to FIG. 1, the lifting device includes a frame 102, a load plate 104 movably disposed on the frame 102, and a back plate 106 moveably disposed on the frame 102. The lifting device further includes first and second horizontal actuators 108*a*, 108*b* as well as first and second arm members 110*a*, 110*b*.

Figure 2:
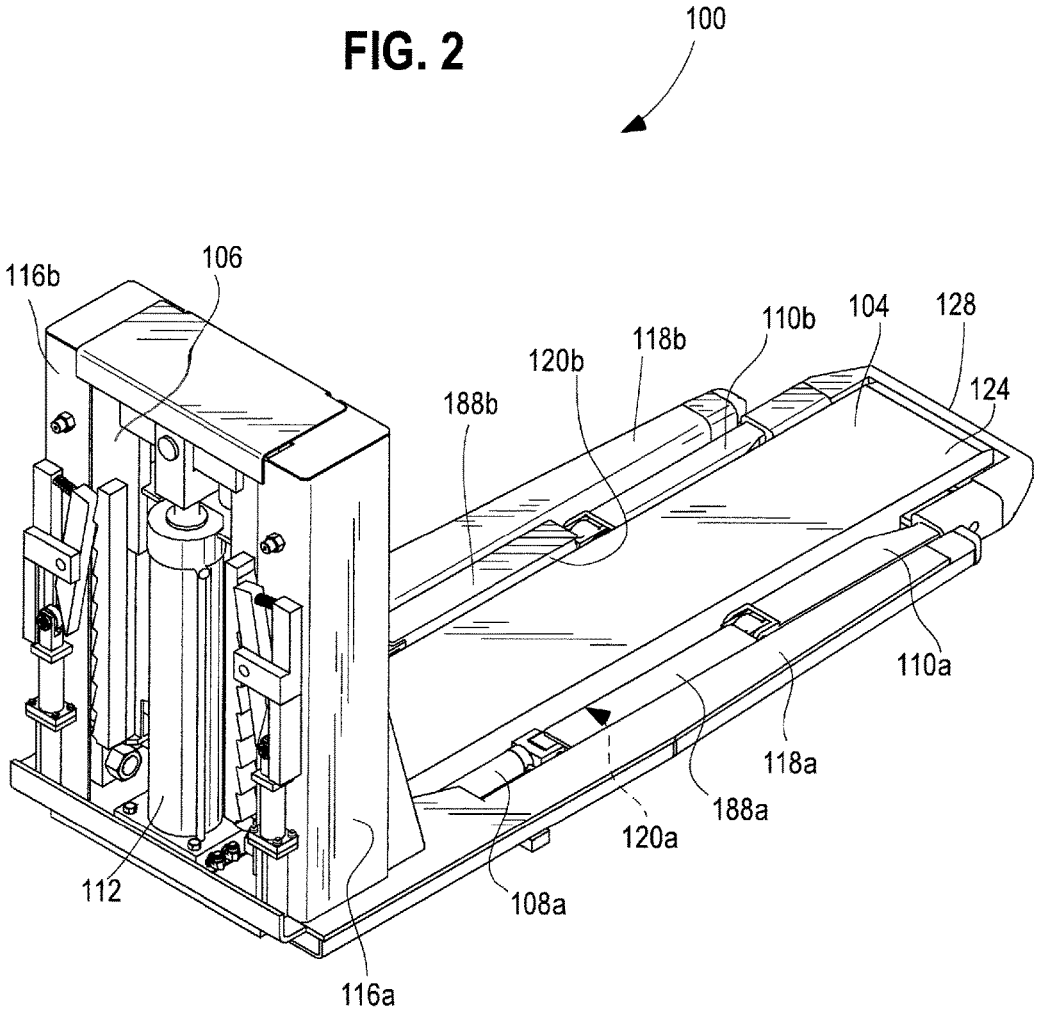
FIG. 2 is an isometric back view of the lifting device in the retracted position.

Referring now to FIG. 2, the lifting device 100 is depicted such that a backside of the frame 102 is shown. The lifting device 100 further includes a first vertical actuator 112 disposed on the frame 102 and operatively coupled to the back plate 106. The vertical actuator 112 transmits to the back plate 106 a first force in a generally upward, first direction. In the depicted embodiment, the first vertical actuator 112 has a bottom end coupled to the frame 102 and an upper end pinned proximal to a top edge of the back plate 106. The bottom end of the first vertical actuator 112 may be bolted down or secured to the frame in another suitable fashion. The end of the first vertical actuator 112 pinned to the top of the back plate 106 may be coupled thereto by a hinge or another suitable connection allowing side-to-side motion of the back plate 106. Additionally, the first and second horizontal actuators 108*a*, 108*b* are operatively coupled to a distal end 126 of the load plate 104 through the first and second aRM members 110*a*, 110*b*. The actuators 108*a*, 108*b*, 112 may be hydraulic cylinders, pneumatic cylinders, electric linear actuators, or any other suitable type of actuator.

The first and second horizontal actuators 108*a*, 108*b* transmit a generally horizontal force to the first and second arm members 110*a*, 110*b* in a second direction substantially transverse to the first direction. In example embodiments, each arm member 110*a*, 110*b* may be a slide crank. Further, the first and second horizontal actuators 108*a*, 108*b* may be attached to the frame 102 using a clevis pin or any other suitable connection type. Thereby, the first and second arm members 110*a*, 110*b* transfer the force produced by the first and second horizontal actuators 108*a*, 108*b* to the load plate 104, causing the load plate 104 to rise in a substantially vertical direction.

Figure 3:
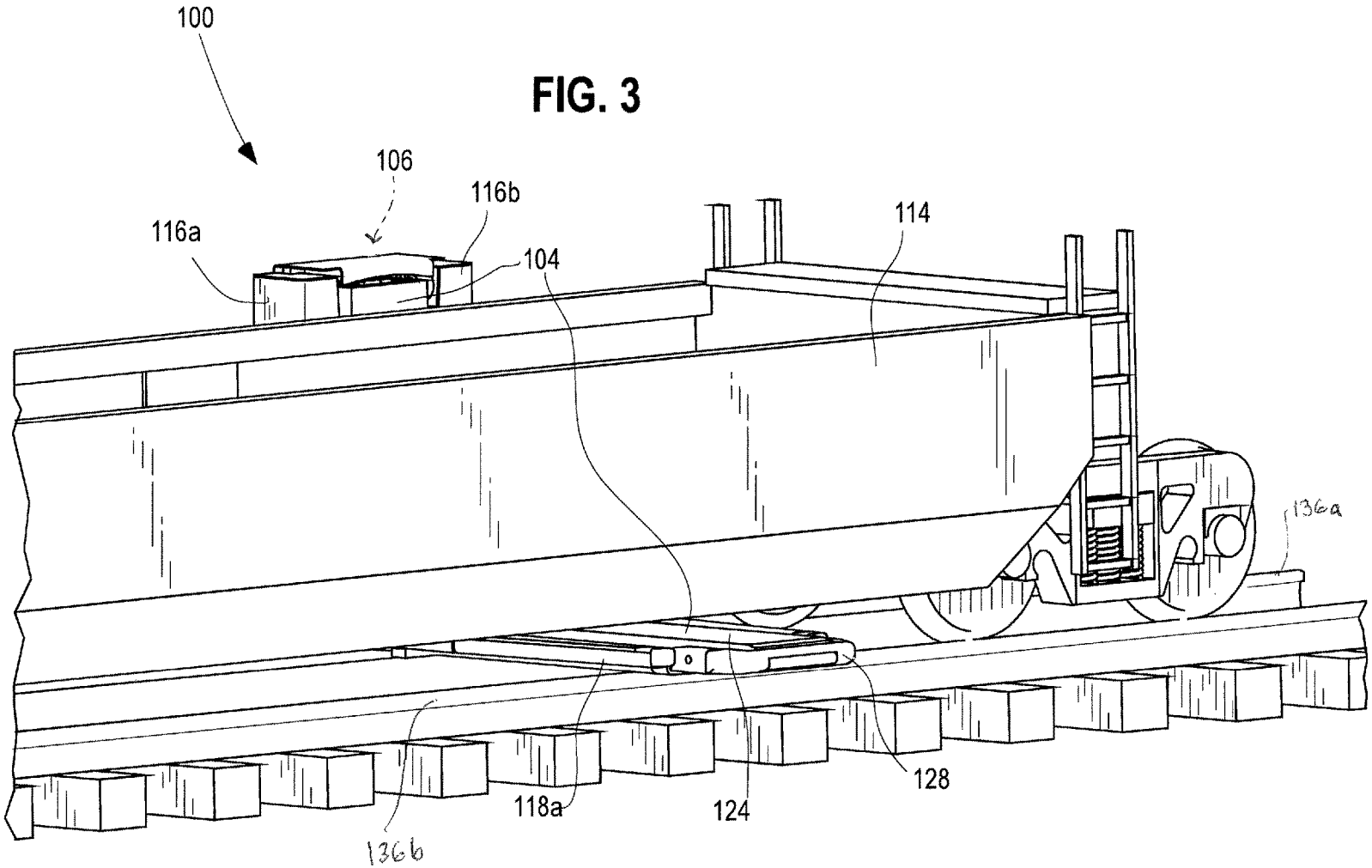
FIG. 3 is an isometric front view of the lifting device in the retracted position arranged underneath a rail car.

The vertical forces received at the load plate 104 from the first and second arm members 110*a*, 110*b* and the first vertical actuator 112 provide the force necessary for the load plate 104 to vertically lift a load, such as a rail car 114 positioned over the load plate 104 as seen in FIG. 3. The load plate 104, arm members 110*a*, 110*b*, and actuators 112, 108*a*, 108*b* begin in a first, retracted position shown in FIGS. 1-3. Likewise, the rail car 114 begins in a first, bottom position arranged above the load plate 104 but not necessarily making contact with the load plate 104 or the back plate 106, although the rail car may rest against the load plate 104 and/or back plate 106 when in the bottom position.

Figure 4:
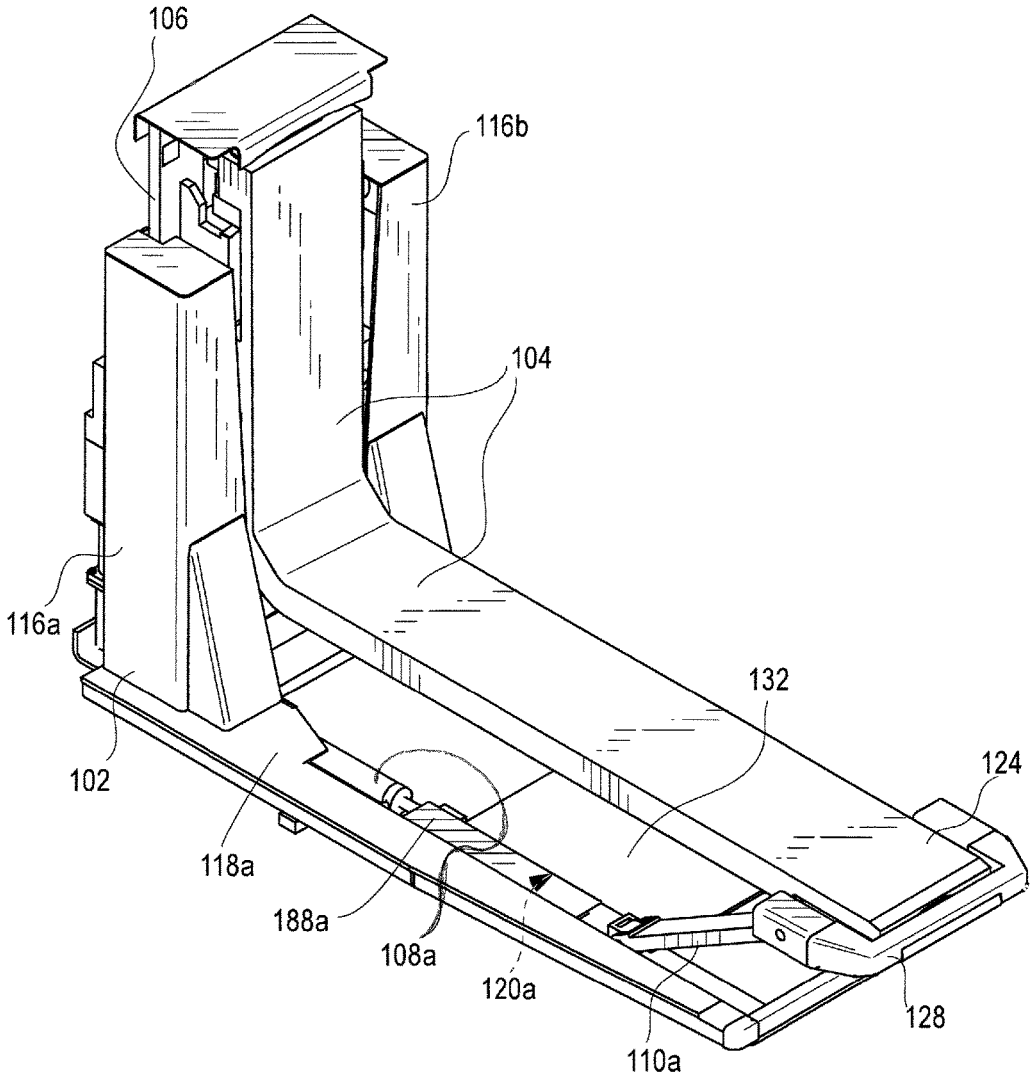
FIG. 4 is an isometric front view of the lifting device in a partially deployed position.
Figure 5:
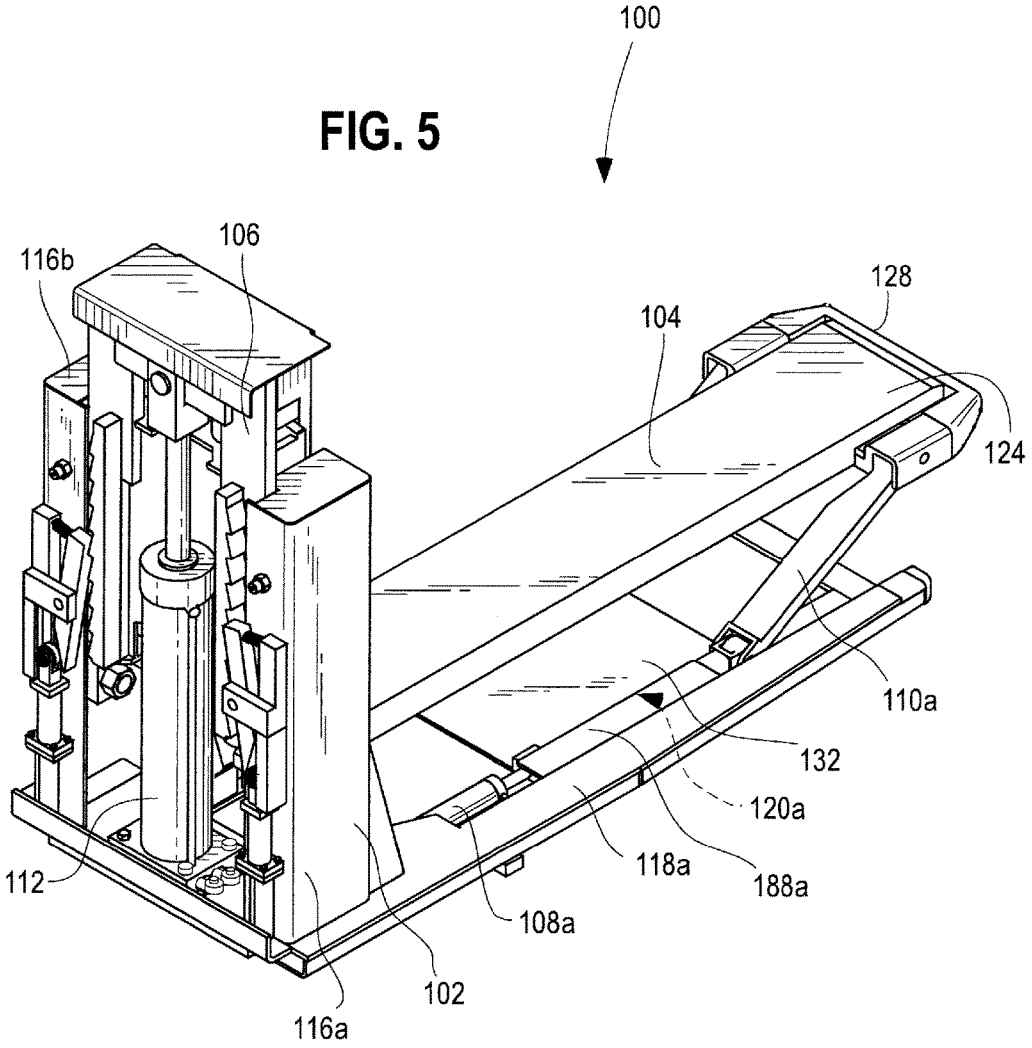
FIG. 5 is an isometric back view of the lifting device in the partially deployed position.

From the first, retracted position the load plate 104 lifts vertically, as shown in FIGS. 4 and 5. The back plate 106 rises vertically in response to the first vertical actuator 112. As the back plate 106 rises, it separates from the first and second vertical side members 116*a*, 116*b* of the frame 102. Additionally, the load plate 104 rises vertically in response to the hinging movement of the first and second arm members 110*a*, 110*b*. The hinging movement of the first and second arm members 110*a*, 110*b* is effectuated by the first and second horizontal actuators 108*a*, 108*b*. The first and second horizontal actuators are arranged alongside and anchored by respective first and second horizontal leg members of the frame 118*a*, 118*b*. Alternatively, the first and second horizontal actuators 108*a*, 108*b* may instead be anchored to the first and second side member 116*a*, 116*b* and merely be configured to run alongside the first and second horizontal leg members 118*a*, 118*b* of the frame 102.

In alternative embodiments, there may instead be one horizontal actuator, one leg member, and one arm member. In other alternative embodiments, there may be more than two horizontal actuators, more than two leg members, and more than two arm members. Further alternative embodiments may combine the first and second side members 116*a*, 116*b* into a single upright frame member. Such alternative embodiments may be combined as may be suitable for a particular application.

The first and second horizontal leg members 118*a*, 118*b* are disposed substantially parallel to and spaced apart from one another. Further, each horizontal leg member 118*a*, 118*b* includes a slide member 120*a*, 120*b* that transfers the force of each horizontal actuator 108*a*, 108*b* to the respective arm member 110*a*, 110*b*. In an example embodiment, the load plate 104 is disposed between the first and second horizontal leg members 118*a*, 118*b* and the slide members 120*a*, 120*b* move horizontally, transverse to the vertical rise of the load plate 104, to cause the hinging motion of the first and second horizontal arm members 110*a*, 110*b*. In example embodiments, the slide members 120*a*, 120*b* may be replaced by or combined with a platen 132 arranged between the first and second horizontal leg members 118*a*, 118*b* of the frame 102. In alternative example embodiments, the horizontal motion of the slide members 120*a*, 120*b* and first and second horizontal actuators 108*a*, 108*b* may be used to drive a scissor mechanism or some other type of linkage arrangement. Further, the connections between the first and second arm members 110*a*, 110*b* and the first and second slide members 120*a*, 120*b* direct the vertical load from the distal end 124 of the load plate 104 to the respective horizontal leg members 118*a*, 118*b* of the frame 102 on either side of the lifting device 100.

The horizontal leg members 118*a*, 118*b* of the frame 102 guide the platen 132 and the slide members 120*a*, 120*b*. Slide members 120*a*, 120*b* may cam along the sides of horizontal leg members 118*a*, 118*b*. The platen 132 is formed to fit between 118*a* and 118*b*. When the load plate 104 is in the first, retracted position the platen 132 is underneath the load plate 104. The slide members 120*a*, 120*b*, and the platen 132 connecting such slide members 120*a*, 120*b*, may be guided by the lowest inside vertical surface 134*a*, 134*b* (see FIG. 12) on the inside of horizontal leg members 118*a*, 118*b*. Wear pads may be arranged between the horizontal leg members 118*a*, 118*b* and the slide members 120*a*, 120*b*. In example embodiments, the wear pads may be fixed to outside vertical surfaces of the slide members 120*a*, 120*b* to prevent deterioration as the slide members 120*a*, 120*b* slide along the lowest inside vertical surfaces 134*a*, 134*b* of the horizontal leg members 118*a*, 118*b*.

The platen 132 coupling first and second slide members 120*a*, 120*b* may operate to keep the horizontal actuators 108*a*, 108*b* synchronized to prevent the first and second arm members 110*a*, 110*b* from raising the respective sides of the load plate 104 uneven vertical distances. Housing plates 188*a*, 188*b* may cover portions of the horizontal leg members 118*a*, 118*b*, the slide members 120*a*, 120*b*, and the horizontal actuators 108*a*, 108*b*. These housing plates 188*a*, 188*b* may be welded to the horizontal leg members 118*a*, 118*b* above the space occupied by slide members 120*a*, 120*b*. The pinned couplings between the first and second horizontal actuators 108*a*, 108*b*, the first and second slide members 120*a*, 120*b*, and the first and second arm members

110*a*, 110*b* are held in alignment by these housing plates 188*a*, 188*b* such that buckling of the pinned couplings is prevented.

Figure 12:
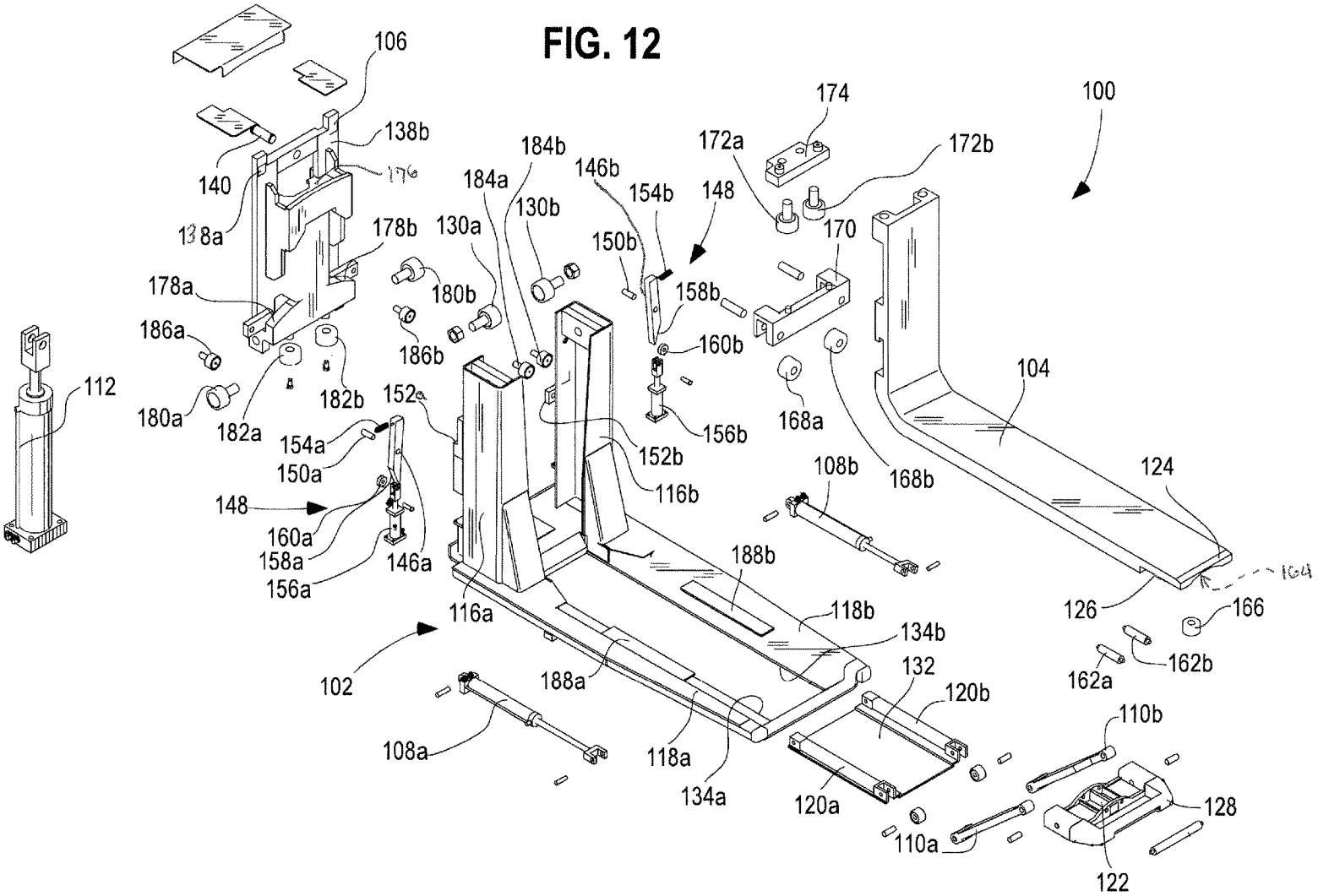
FIG. 12 is an exploded view of the lifting device.

As seen in FIGS. 1, 2, 4, and 5, the first and second arm members 110*a*, 110*b* are operatively coupled to an end of the load plate 104 distal to the first and second side members 116*a*, 116*b* of the frame 102. The first and second arm members 110*a*, 110*b* may be connected to the load plate by hinges, trunnions, ball joints, or another suitable connection type. The load plate 104 has an end surface 124 distal to the back plate 106 that defines a channel 126, as seen in FIG. 12, extending along a horizontal axis of the load plate 104. At least one trunnion 122 is positioned within the channel (see FIG. 15). Further, a protective cap 128 partially surrounds the end surface 124 of the load plate 104.

Figure 6:
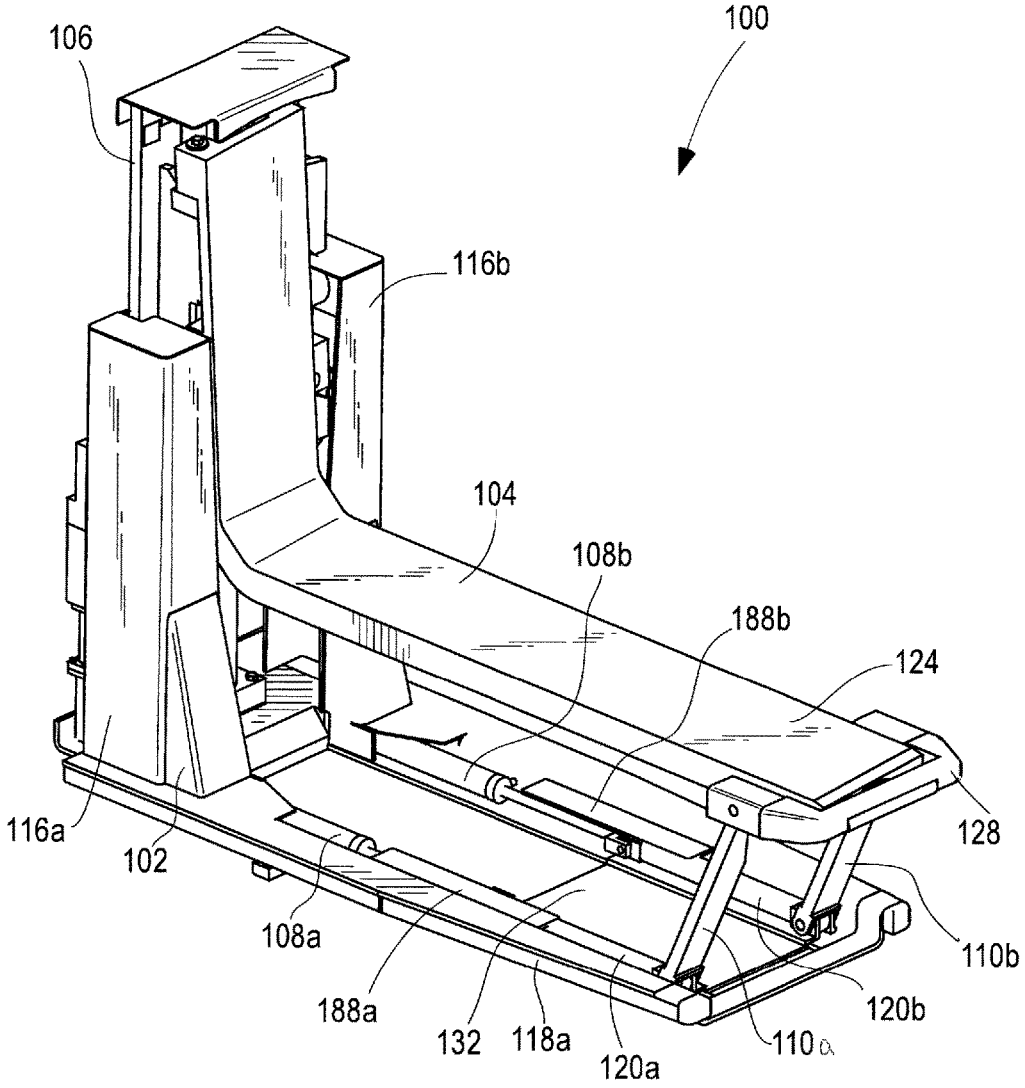
FIG. 6 is an isometric front view of the lifting device in a deployed position.
Figure 7:
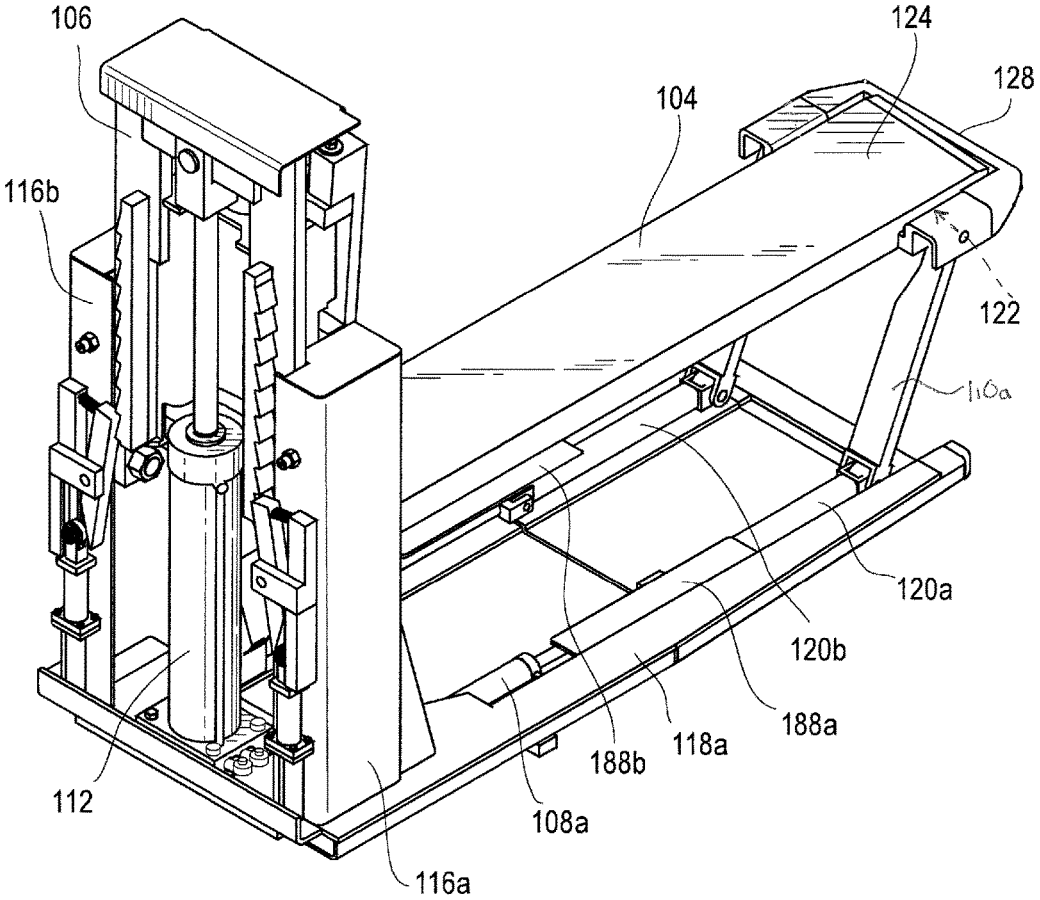
FIG. 7 is an isometric back view of the lifting device in the deployed position.

Referring now to FIGS. 6 and 7, the load plate 104 and back plate 106 are shown reaching the second, extended position. In the second, extended position, the back plate 104 has risen further above the first and second side members 116*a*, 116*b*. Additionally, the first and second slide members 120*a*, 120*b* have moved further horizontally as a result of continued force exerted by the first and second horizontal actuators 108*a*, 108*b*. The movement of the first and second slide members 120*a*, 120*b* causes corresponding additional hinging movement of the first and second arm members 110*a*, 110*b* effectuating further rise of the load plate 104.

Figure 13:
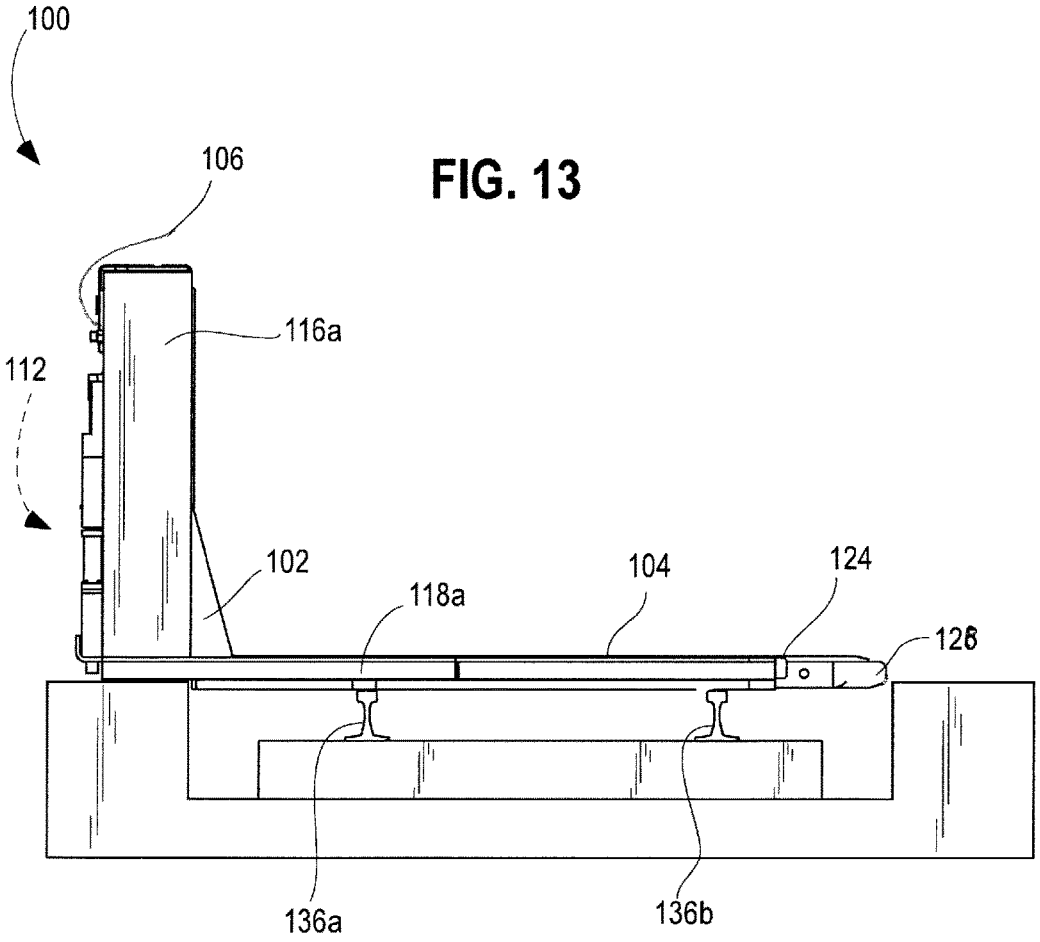
FIG. 13 is a side elevational view of the lifting device arranged on a railway.

In the example embodiment shown in FIGS. 6 and 7, the load plate 104 reaches the second, extended position before the arm members 110*a*, 110*b* have fully hinged to a vertical position forming right angles with the respective first and second horizontal leg members 118*a*, 118*b* of the frame 102. In the example embodiment shown, the angle of the arm members 110*a*, 110*b* when the load plate 104 reaches the second, extended position is optimized to transfer the load from the load plate 104 through the frame 102 to the top of the rail 136*b* supporting the distal end 124 of the load plate 104 and lifting device 100 (see FIG. 13 showing rails 136*a*, 136*b*). In alternative embodiments, the second, extended position of the load plate 104 may correspond to an arm member position that is at 90 degrees to the horizontal leg members 118*a*, 118*b* or past 90 degrees such that the angle formed interior to the lifting device 100 between each arm member 110*a*, 110*b* with the respective horizontal leg member 118*a*, 118*b* is acute. Further still, the upper, extended position of the load plate 104 may be within a vertical range from the leg members 118*a*, 118*b* of the frame 102, and/or within a range of angles between the arm members 110*a*, 110*b* and the leg members 118*a*, 118*b* of the frame 102.

Figure 8:
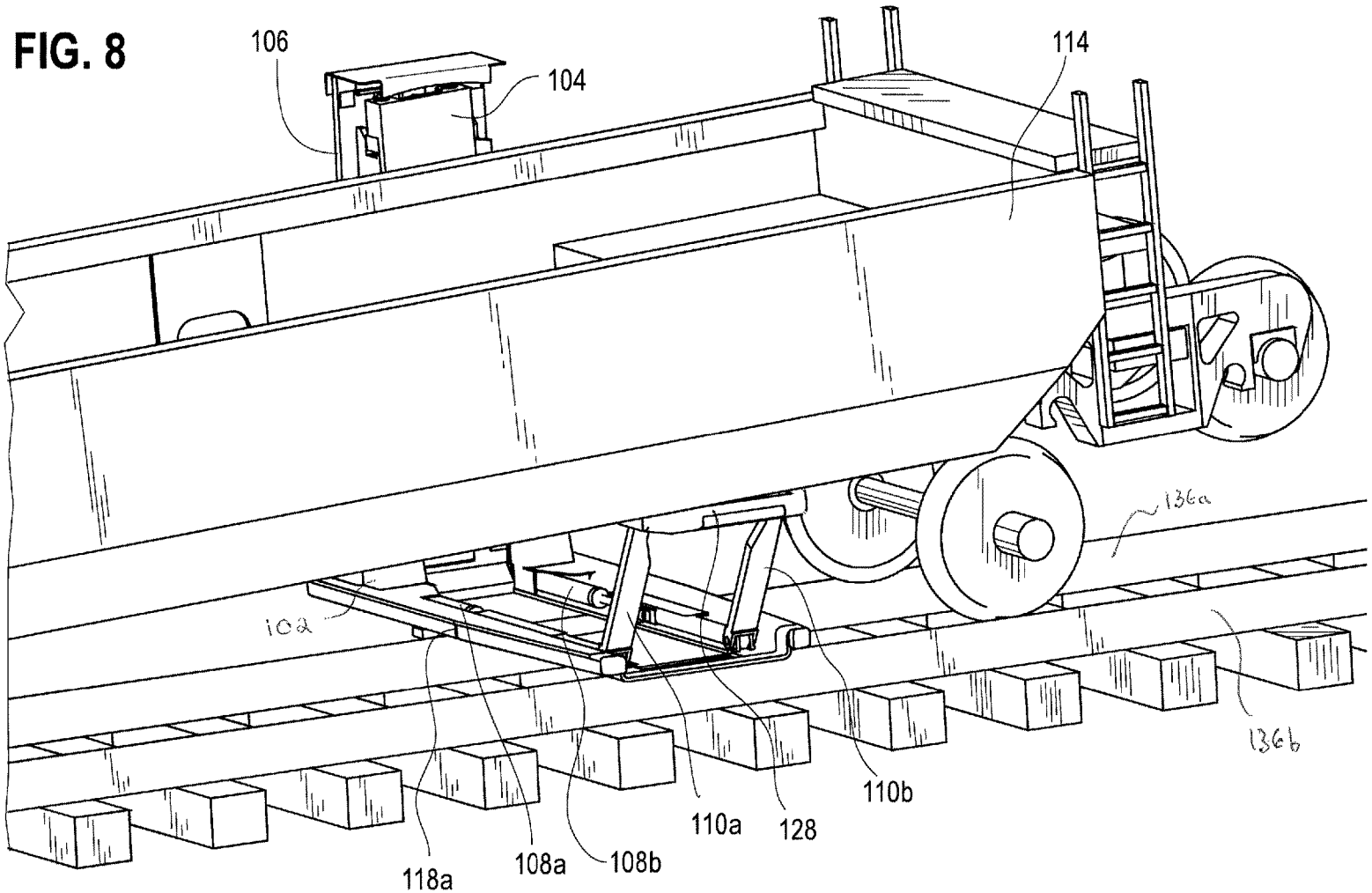
FIG. 8 is an isometric front view of the lifting device in the deployed position arranged such that the rail car is lifted.
Figure 9:
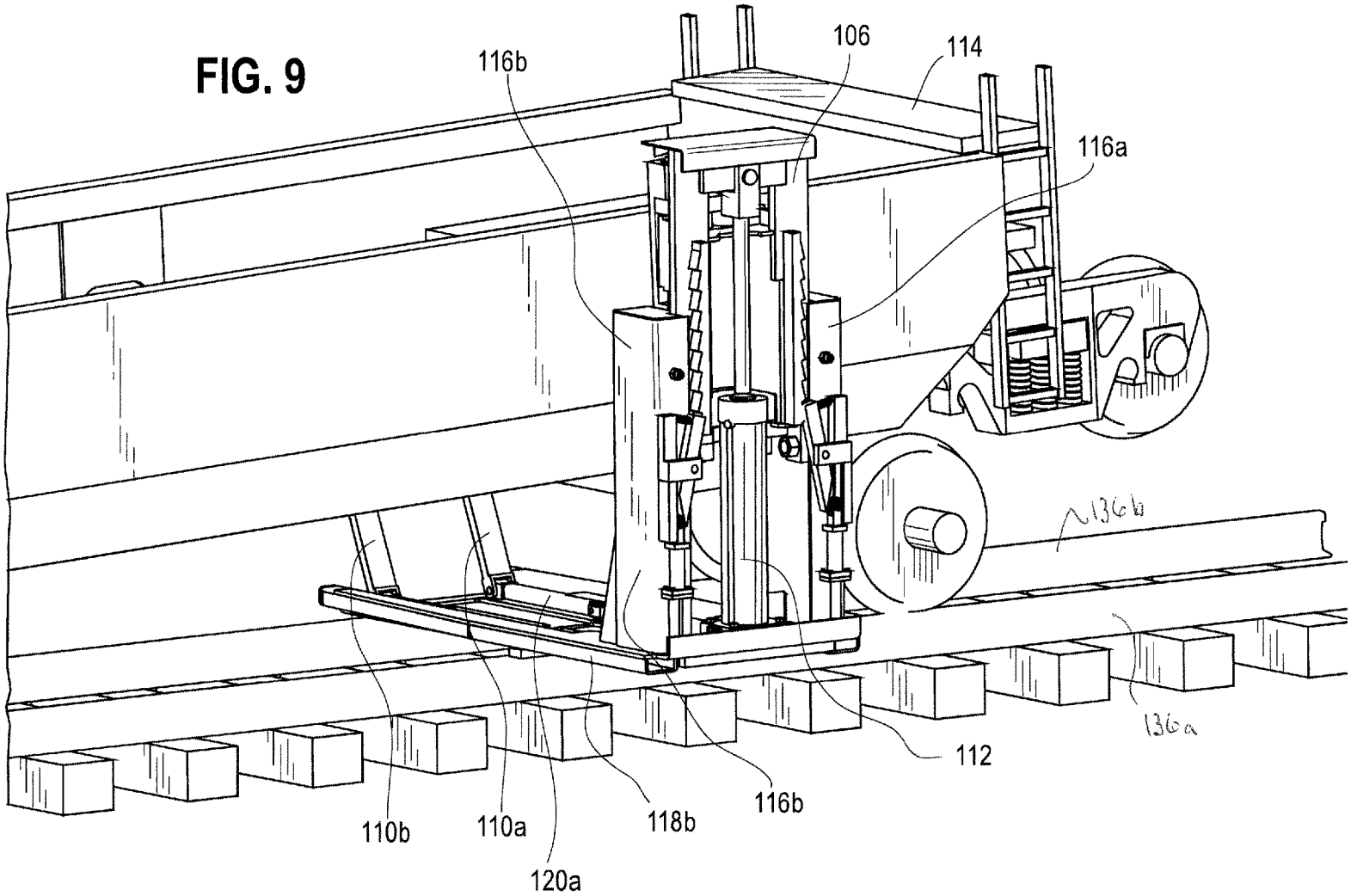
FIG. 9 is an isometric back view of the lifting device in the deployed position arranged such that the rail car is lifted.

As shown in FIGS. 8 and 9, when the load plate 104 and the back plate 106 reach the second, extended position, the rail car 114 contacts the load plate 104 and is at least partially lifted. One or more of the rail car 114 wheels may be lifted above the rails. The vertical distance the rail car 114 moves depends on both the clearance of the rail car from the rails and the elevation of the upper, extended position reached by the load plate 104. Maintenance on the wheels or undercarriage of the rail car 114 may be performed while the rail car 114 partially rests on the load plate 104 in the second, extended position. Holding of the load plate 104 in the upper, extended position is detailed further below.

Figure 15:
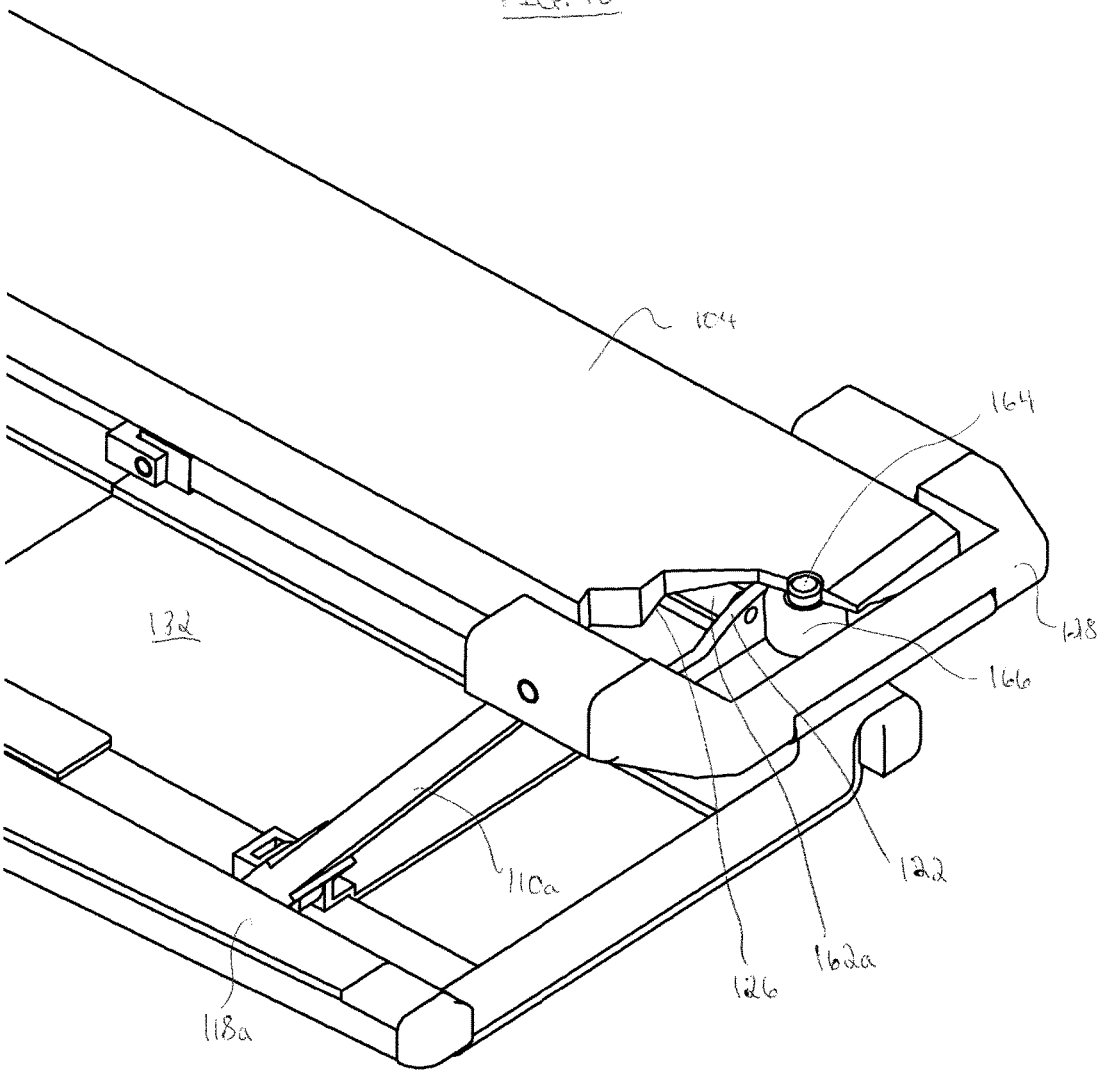
FIG. 15 is a detailed front isometric view from above of the lifting device with a portion of the load plate cut away.

As the load plate 104 comes into contact with the underside of the rail car 114 and the rail car 114 begins to rise, the load plate 104 may tilt in one direction, as shown in FIGS. 8 and 9 in order to maintain contact with the rail car 114. Tilting of the load plate 104 is accomplished when the weight of the rail car 114 causes the load plate 104 to tilt in one particular direction. As the weight of the rail car 114 born by the load plate 104 increases, the load plate 104 rotates on the trunnion 122 extending through the channel 126 along the horizontal axis of the load plate 104. Referring ahead to FIG. 15, the channel 126 is a concave arch on the bottom of the distal end 124 of the load plate 104. The axis of the arched channel 126 is horizontal and perpendicular to the rails 136*a*, 136*b*. The trunnion 122 contacts the bottom of the channel 126 with rollers 162*a*, 162*b* having axes parallel to the axis of 126. The rollers 162*a*, 162*b* are arranged within the trunnion 122 and the load plate 104 rests on said rollers 162*a*, 162*b*. In the example embodiment shown, a vertical shaft 164 protrudes down from the channel 126. The shaft 164 may be welded to the bottom surface of the load plate 104 in the channel 126. A single, relatively large diameter roller 166 (see FIG. 12 also) is orientated with a vertical hole corresponding to the vertical shaft 164 such that the roller 166 is arranged on the shaft 164. This roller 166 movably couples the trunnion 122, the protective end cap 128, and the load plate 104 together proximal the distal end 124 of the load plate 104.

Figure 10:
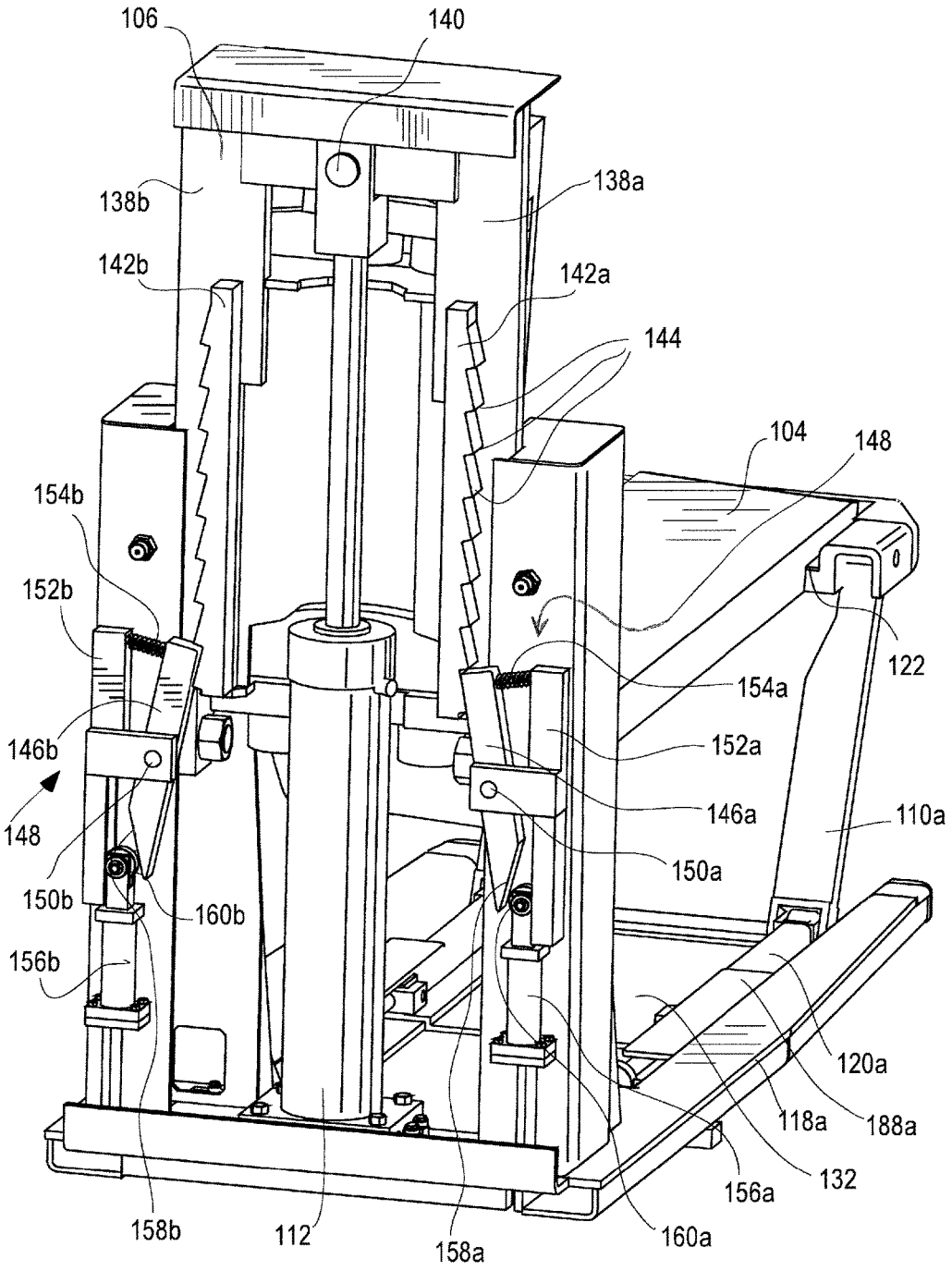
FIG. 10 is an isometric view of the back of the lifting device showing a back plate and frame of the lifting device when said back plate is partially supported by pins extending from the frame.

Referring now to FIG. 10, the back of the lifting device 100 is shown in greater detail. Once the rail car 114 has been raised to a desired height, the actuators 108*a*, 108*b*, 112 are stopped, and the lifting device 100 supports the rail car 114, thereby allowing work crews to perform maintenance or whatever work is required on the car 114. The backside of the frame, facing away from the railway in the embodiment shown here, includes the first and second side members 116*a*, 116*b* along either side of the back plate 106. Likewise, the back plate 106 may be a continuous plate or may be separated into first and second adjacent back plate members 138*a*, 138*b* arranged alongside the first and second side members 116*a*, 116*b* of the frame 102.

Figure 16:
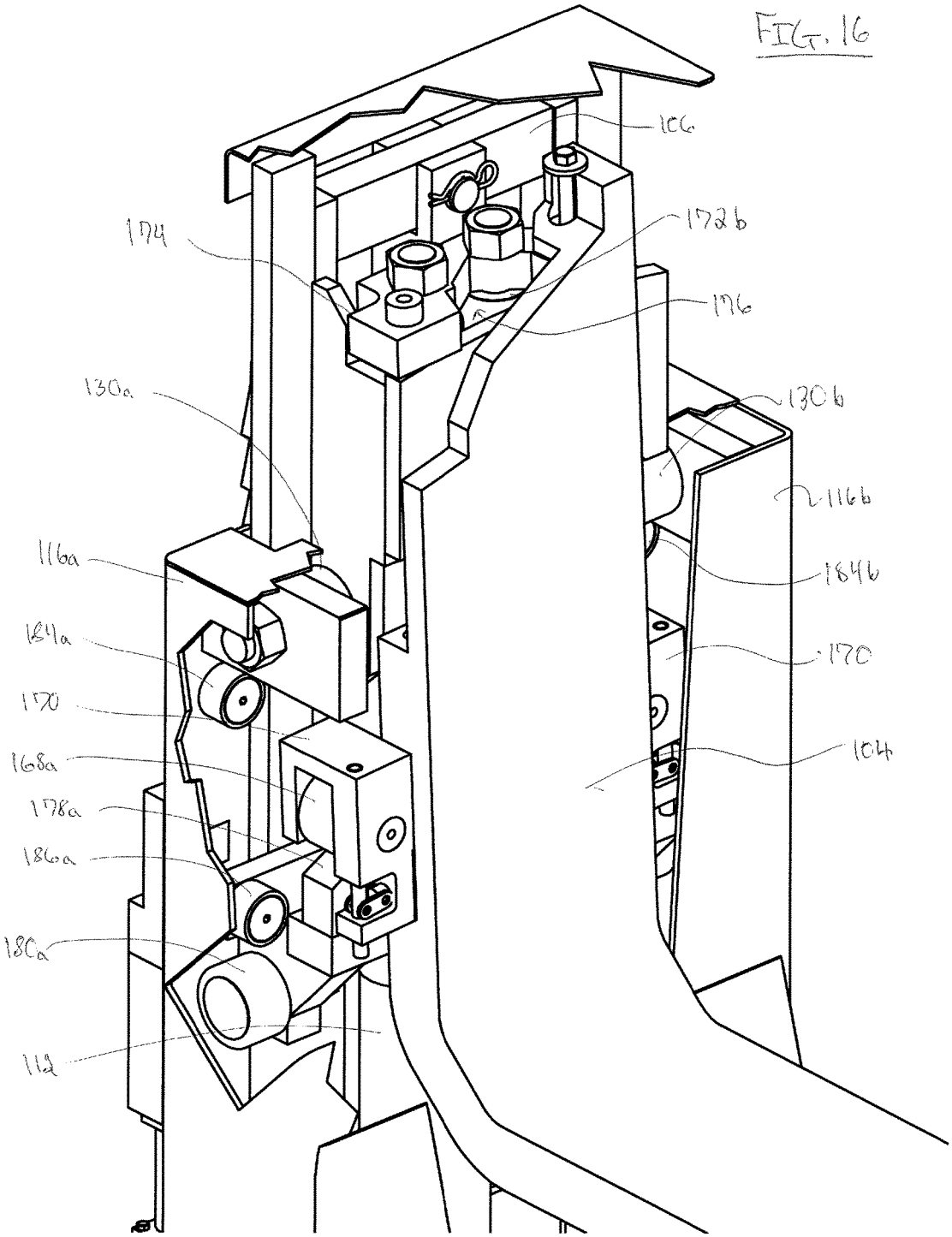
FIG. 16 is a detailed front isometric view from above of the lifting device with portions of the load plate and frame cut away.
Figure 17:
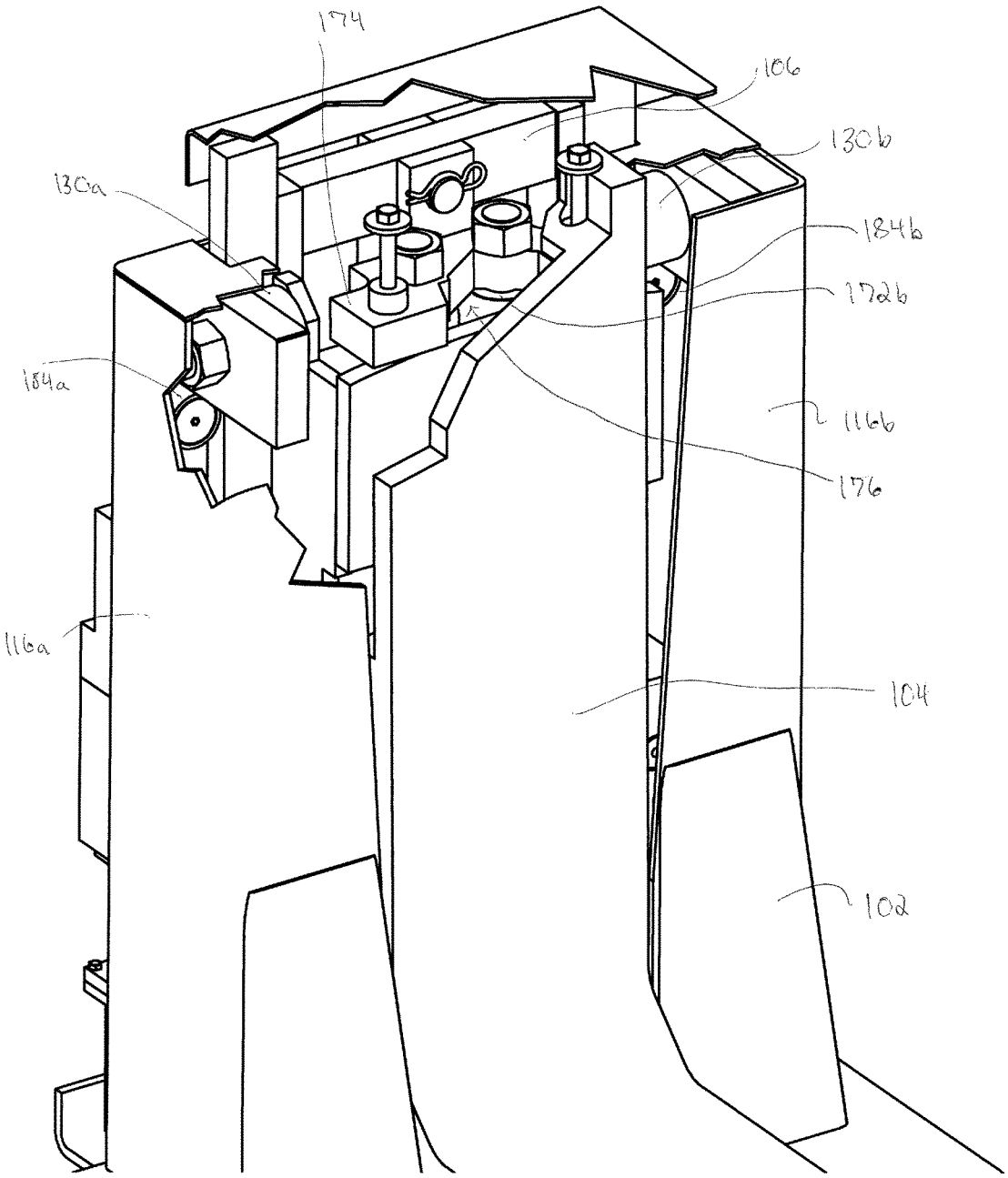
FIG. 17 is a detailed front isometric view from above of the lifting device with increased portions of the load plate and the frame cut away.

Referring ahead now to FIGS. 12, 16, and 17, each side member 116*a*, 116*b* contains a roller 130*a*, 130*b* or another suitable contact point along which the back plate 106 or respective back plate member 138*a*, 138*b* travels during vertical movement. Further, relatively small rollers 184*a*, 184*b* may be mounted to the interior of the side members 116*a*, 116*b* to roll along the outer vertical side edge of back plate members 138*a*, 138*b*. In addition to rollers mounted on the frame 102, each side member 116*a*, 116*b* may contain a guide surface and rollers may be located on either side of the back plate 106 or on each respective back plate member 138*a*, 138*b* to provide another suitable contact point along which the back plate 106 travels. Specifically, relatively small rollers 186*a*, 186*b* located on back plate members 138*a*, 138*b* contact the inner surfaces of side members 116*a*, 116*b* to guide the movement of the back plate 106. Embodiments further include some combination of guide surfaces and rollers to provide a track within each side member 116*a*, 116*b* to guide the respective back plate members 138*a*, 138*b* during vertical movement of the back plate 106.

Further in this embodiment, the load plate 104 tilts independent of the back plate 106, which remains vertical. Load plate 104 rotates on an axis where the load plate 104 is coupled to the back plate 106, the axis being parallel to the axis where the channel 126 rotates on the trunnion 122 (see FIG. 15). Referring again to FIGS. 12, 16, and 17, lower rollers 168*a*, 168*b* are held in bracket 170 that, in turn, is attached to load plate 104. Upper rollers 172*a*, 172*b* are fixed to roller plate 174 that is fixedly attached to the load plate 104. The vertical load resulting from rail car 114 being raised is transferred from load plate 104 through lower rollers 168*a*, 168*b* to the back plate 106 and thereby to the frame 102. Upper rollers 172*a*, 172*b* hook onto the back plate in cavity 176 to lever the top of the load plate 104 towards the back plate 106. The lower rollers 168*a*, 168*b* are arranged vertically near the bottom of back plate 106 in contact with angles 178*a*, 178*b*. The angles 178*a*, 178*b* of the back plate 106 support the load of the load plate 104 as transferred thereto through the lower rollers 168*a*, 168*b*.

Further, the back plate 106 has coupled thereto horizontal rollers 180*a*, 180*b* and vertical rollers 182*a*, 182*b*. The vertical rollers 182*a*, 182*b* contact the bottom back surface of the load plate 104 and form an operative pairing with the horizontal rollers 180*a*, 180*b*. The horizontal rollers 180*a*, 180*b* transfer a load from the back plate 106 to the side members 116*a*, 116*b* of the frame 102 while the bottom rear of the load plate 104 transfers a load through the vertical rollers 182*a*, 182*b* to the back plate 106. Thus, the lower rollers 168*a*, 168*b*, upper rollers 172*a*, 172*b*, horizontal rollers 180*a*, 180*b*, and vertical rollers 182*a*, 182*b* movably dispose the load plate 104 on the back plate 106. The combination of rollers provides for shifting of weight as the load plate 104 tilts under the load of the raised rail car 114 while the back plate 106 remains anchored. The back plate 106 does not tilt in this example embodiment, but remains substantially vertical while guided and held in place by the guide surfaces and rollers of the side members 116*a*, 116*b*.

The pressure born by the frame side members 116*a*, 116*b* due to the load on the load plate 104 is greatest when the load plate 104 is nearest the first, retracted position (see FIGS. 1 and 2). This occurs because the angle of the arm members 110*a*, 110*b* is lowest in the first, retracted position so the resultant vertical force provided by said arm members 110*a*, 110*b* is lower than once the arm members 110*a*, 110*b* move from horizontal to nearer vertical.

Once the load plate 104 contacts the bottom of the rail car 114 the suspension springs of the rail car 114 must be off loaded before the load plate 104 bears the full load of the rail car 114. Thus the load is not maximized until after the angle between the arm members 110*a*, 110*b* and the horizontal leg members 118*a*, 118*b* has increased resulting in the arm members 110*a*, 110*b* supporting more of the load and thereby reducing the moment at the frame side members 116*a*, 116*b*. Reduction of moment experienced at the side members 116*a*, 116*b* is important at this stage because the horizontal rollers 180*a*, 180*b* and the rollers 130*a*, 130*b* that transfer the forces from the back plate 106 to the frame side members 116*a*, 116*b* are moving nearer one another as the back plate 106 rises vertically. The convergence of the rollers focuses the point on the frame side members 116*a*, 116*b* supporting the load and elevates the load supporting point along the frame 102.

The rollers 130*a*, 130*b* nearer the top of the frame 102 are attached to the frame side members 116*a*, 116*b* while the horizontal rollers 180*a*, 180*b* are attached to the bottom of the back plate 106, as detailed above. When the arm members 110*a*, 110*b* reach the second, extended position of about 70 degrees, more than half of the weight of the rail car 114 is supported by the arm members 110*a*, 110*b*. Because such a significant portion of the weight of the rail car 114 is carried by the arms 110*a*, 110*b* in the second, extended position, the optimal angle for transferring said weight to the rail 136*b* is utilized in this position.

In an alternative embodiment, the back plate 106 may tilt at the same time as when the load plate 104 tilts, as discussed in further detail above. The rollers 130*a*, 130*b* located on the frame side members 116*a*, 116*b* may be spring loaded so that the rollers 130*a*, 130*b* maintain contact with and travel along their respective back plate members 138*a*, 138*b* until the first vertical actuator 112 reaches its desired length of travel. In an alternative embodiment, the first vertical actuator 112 may be pinned to the bottom of the frame 102 so as to allow the actuator 112 to tilt along with the back plate 106.

Referring still to FIG. 10, the back plate 106 is shown in greater detail. In this embodiment, the first vertical actuator 112 is operatively coupled to the back plate 106 by a hinge pin 140 located near the upper portion of the back plate 106. The hinge pin 140 allows the back plate 106 to tilt, thereby allowing the load plate 104 to tilt as described above. In various embodiments, the back plate 106 and the load plate 104 may be coupled to one another by connection points that allow the load plate 104 to tilt independently from the back plate 106, or the back plate 106 and the load plate 104 may be fixedly attached to one another such that both plates tilt in unison or simultaneously.

The back plate 106 has first and second ladders 142*a*, 142*b* of support ledges 144 arranged along each side thereof. Each support ledge 144 of the ladders 142*a*, 142*b* is shaped to accept a support pin 146*a*, 146*b* disposed on the respective frame side member 116*a*, 116*b*. In the embodiment depicted in FIGS. 10 and 11, the ladders 142*a*, 142*b* are disposed on the first and second adjacent back plate members 138*a*, 138*b*. The ladders 142*a*, 142*b* protrude from the back plate members 138*a*, 138*b* such that the support ledges 144 extend out from the back plate 106 and past the first and second side members 116*a*, 116*b* of the frame 102.

Furthermore, the first and second frame side members 116*a*, 116*b* have disposed thereon a pin mechanism 148 for engaging and disengaging the support pins 146*a*, 146*b* with the support ledges 144 of the respective first and second ladders 142*a*, 142*b*. Each pin mechanism includes the support pin 146*a*, 146*b*, support pin hinge 150*a*, 150*b*, support pin mount 152*a*, 152*b*, and support pin spring 154*a*, 154*b*. Second and third vertical actuators 156*a*, 156*b* are disposed on the first and second frame side members 116*a*, 116*b* and are operatively coupled to the respective pin mechanism 148 on each side.

The pin mechanisms 148 are substantially identical therefore, only a first side will be described in detail. The support pin mount 152*a* is fixedly attached to the frame side member 116*a*. Disposed on the mount 152*a* are the support pin hinge 150*a* and the support pin spring 154*a*. The support hinge 150*a*, travels through the support pin 146*a*, and attaches to the frame side member 116*a* thus joining the support pin 146*a* thereto. The support pin spring 154*a* is arranged between a top portion of the mount 152*a* and a top portion of the support pin 146*a*. The spring 154*a* pushes the support pin 146*a* away from the mount 152*a* thereby causing the support pin 146*a* to pivot on the hinge 150*a*.

The consistent pressure of the spring 154*a* pushes the support pin 146*a* to contact the ladder 142*a* such that as the ladder 142*a* moves upwards the support pin 146*a* cams therealong. As the back plate 106 and ladder 142*a* rise, the support pin 146*a* engages with successive support ledges 144 along the vertical length of the ladder 142*a*. In this way, the back plate 106 becomes locked above particular heights corresponding to support ledges 144. Such a mechanism for providing support to the back plate 106, and therethrough supporting the load plate 104, is arranged on both the first and second side frame members 116*a*, 116*b* so as to support the back plate 106 from both sides.

The above describe support mechanism ensures that the load plate 104 is supported even when the first vertical actuator 112 is not providing a supportive or motive upward force on the back plate 106. The support pins 146*a*, 146*b* may provide support to the back plate 106 and load plate 104 when the vertical actuator 112 is not providing an upward force for the purpose of saving energy, preserving battery life, or as a safety mechanism that prevents sudden downward vertical movement of the load plate 106 and the rail car 114 resting thereon. The support pins 146*a*, 146*b* therefore protect personnel and/or equipment beneath the lifted load plate 104 and rail car 114. The spring tension keeps the support pins 146*a*, 146*b* engaged even when the back plate 106 tilts with the load plate 104 by maintaining consistent pressure on the pins 146*a*, 146*b* but also allowing the pins 146*a*, 146*b* to compress the springs 154*a*, 154*b*, if necessary, while remaining engaged with the ladders 142*a*, 142*b*.

In alternative embodiments, a support mechanism similar to the above-described mechanism of support pins ratcheting the back plate 106 may be used to hold the positions of the arm members 110*a*, 110*b* when supporting the weight of the rail car 114. Such an additional support mechanism may be arranged along the first and second leg members 118*a*, 118*b*, or under the distal end 124 of the load plate 104. Further, alternative embodiments may include a single support mechanism as described above connecting the back plate 106 and frame 102, as opposed to support mechanisms on each side of the back plate 106 and the respective side frame members 116*a*, 116*b*. In still further alternative embodiments, more than two support mechanisms similar to that described above may be included for supporting the back plate 106 with the frame 102.

As discussed above, the support pins 146*a*, 146*b* engage the ledges 144 of their respective ladders 142*a*, 142*b* during the vertical rise of the back plate 106. To lower the rail car 114, the process described above is reversed and the first vertical actuator 112 and the first and second horizontal actuators 108*a*, 108*b* are retracted. Retraction of the first vertical actuator 112 allows the back plate 106 to lower vertically. Likewise retraction of the first and second horizontal actuators 108*a*, 108*b* pulls the ends of the moveable arm members 110*a*, 110*b* toward the frame side members 116*a*, 116*b*, thus causing the distal end 124 of the load plate 104 to move in a generally downward direction while, at the same time, the back plate 106 is lowered between the side frame members 116*a*, 116*b*.

Alternatively, the actuators 112, 108*a*, 108*b* may not actively retract the back plate 106 and arm members 110*a*, 110*b*, but instead simply allow the back plate 106 and load plate 104 to lower under the power of gravity, guided by the rollers 130*a*, 130*b*, within the side frame members 116*a*, 116*b*, and the arm members 110*a*, 110*b*. The actuators 112, 108*a*, 108*b* may further provide only limited resistance to allow for a controlled descent of the back plate 106 and load plate 104.

For the back plate 106 to lower, either under power of gravity or in response to retraction of the first vertical actuator 112, the support pins disengage from the support ledges 144. The second and third vertical actuators 156*a*, 156*b* disposed below the support pin mechanisms 148 provide disengagement of the support pins 146*a*, 146*b*. The second and third vertical actuators 156*a*, 156*b* contact the support pins 146*a*, 146*b* at a lower end, distal to the end of the support pin that engages the ledges 144. The lower end of each support pin 146*a*, 146*b* has an angled surface 158*a*, 158*b* thereon. Further, each of the second and third vertical actuators 156*a*, 156*b* has a roller 160*a*, 160*b* disposed on the end thereof for operatively contacting the angled surfaces 158*a*, 158*b* of the support pins 146*a*, 146*b*. The second and third vertical actuators 156*a*, 156*b* may be hydraulic cylinders, pneumatic cylinders, electric linear actuators, or any other suitable type of actuator.

Figure 11:
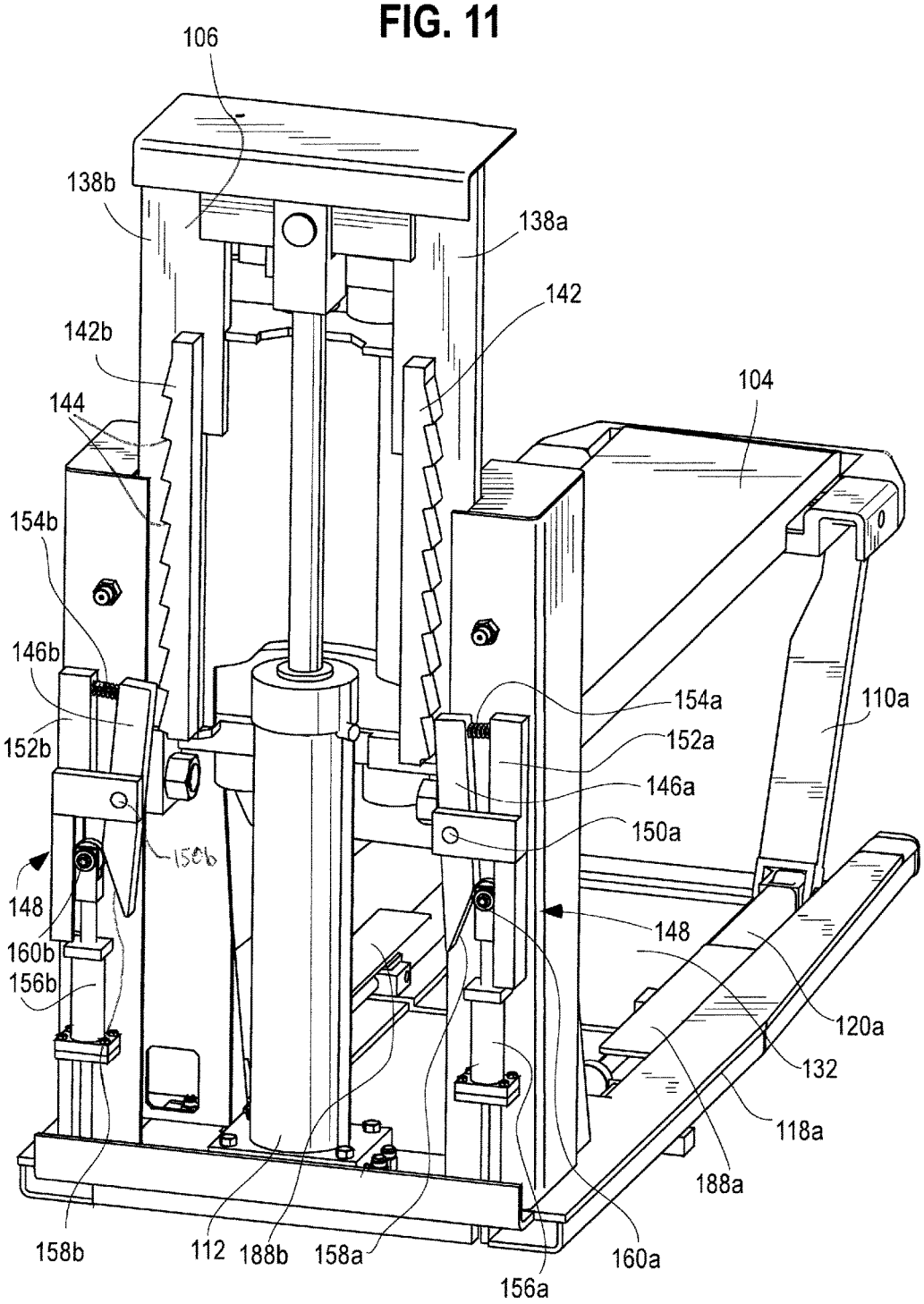
FIG. 11 is an isometric view of the back of the lifting device showing the back plate and frame with the pins disengaged.

The disengagement of the support pins 146*a*, 146*b* will be described with respect to a first side only because the lowering of the back plate 106 operates in a similar fashion on both sides of the frame 102. Referring now to FIG. 11, the vertical actuator 156*a* extends until the roller 160*a* applies pressure to the angled surface 158*a* on the bottom end of the support pin 146*a*. The force of the vertical actuator 156*a*, as applied through the roller 160*a*, causes the support pin 146*a* to hinge on the support pin hinge 150*a*. The vertical actuator 156*a* provides enough pressure that the support pin 146*a* levers against the support pin spring 146*a* thereby compressing the spring 146*a*.

Upon compression of the support pin spring 146*a* by the upper end of the support pin 146*a*, the upper end of the support pin 146*a* disengages the ledge 144 with which it was engaged. The vertical actuator 156*a* applies continued force such that the spring 154*a* remains compressed allowing the upper end of the support pin 146*a* to clear the ledges 144 of its respective ladder 142*a* during descent of the back plate 106 to the first, retracted position. When the actuators 112, 108*a*, 108*b* are fully retracted and the lifting device 100 is in the first, retracted position, the rail car 114 is repositioned on the rails.

Figure 14:
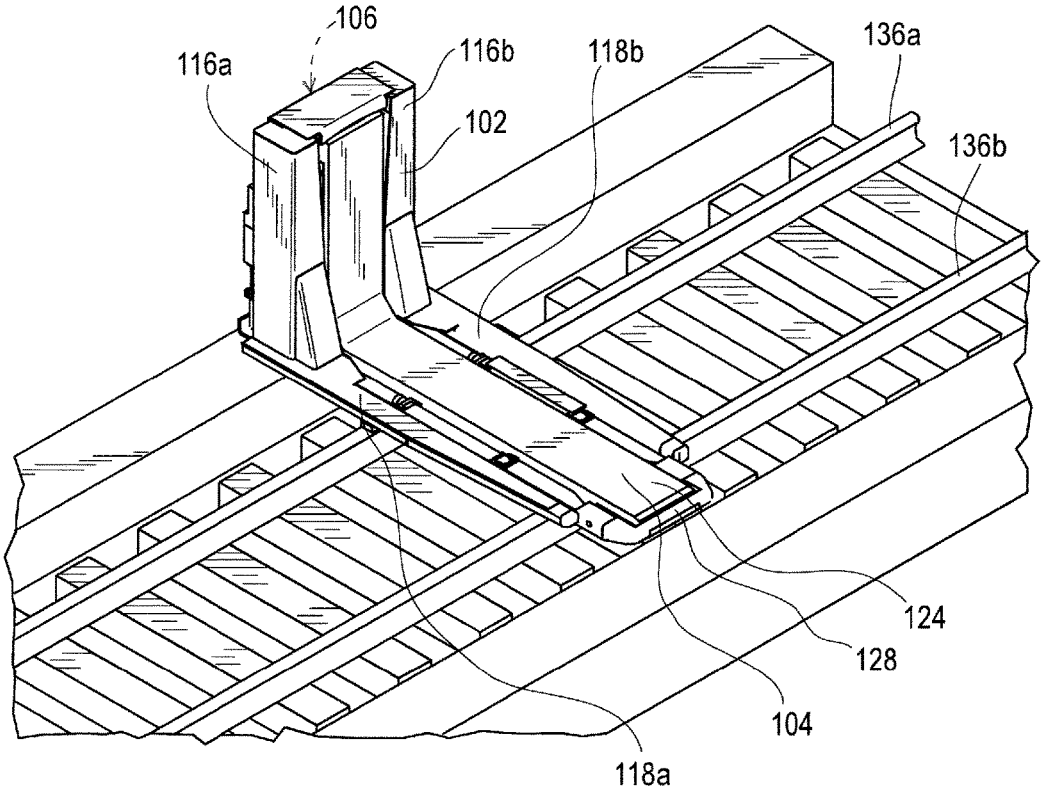
FIG. 14 is a front isometric view from above of the lifting device arranged on the railway.

Referring now to FIGS. 13 and 14, during operation, the lifting device 100 is placed next to the rail car 114 with the load plate 104 substantially perpendicular to the rails. The lifting device 100 may be supported by the rails, the ground alongside the railway, or another structure along the railway. The first and second horizontal leg members 118*a*, 118*b* of the frame may rest directly on the rails as shown in FIG. 13. The frame 102 may also support other equipment such as a wheel-changing device, controls, or other maintenance or safety apparatuses. In an embodiment, the lifting device 100 may be used to raise a rail car 114 to effect a change of the wheel and axle assembly.

The lifting device may be controlled manually with a simple up and down lever. The actuators used therein may be all hydraulic actuators with quick connections to an external hydraulic supply. Alternatively, a hydraulic power supply may be mounted directly on the frame 102. In example embodiments, a gas or diesel engine or electric motor may drive a pump, tank, and/or controls mounted to the frame 102. Such a system may use manual hydraulic lever valves or solenoid valves with push button controls. Limit switches may be used to sense the first, retracted position and the second, extended position of the load plate 104. Limit switches may also be used to verify conditions prior to operation such as engagement and/or disengagement of the support pins 146*a*, 146*b* or any other similar support mechanism. The controls used for the lifting device 100 may be combined with various other sensors, such as sensors that verify that a specific area is clear of obstacles prior to lowering the load plate 104.

In an alternative embodiment, electronics could be used to control the hydraulic pressure and flow during raising and lowering of the load plate 104. Strain gauges may be appropriately installed to measure and report the load being lifted as well as the state of stress for critical components. In an example embodiment, the hydraulic actuator cylinders may be sized such that a single pressure level applied to the lifting device 100 results in all the cylinders producing the appropriate forces.

The embodiment(s) detailed above may be combined, in full or in part, with any alternative embodiment(s) described.

As many changes could be made in the above constructions without departing from the scope of the disclosure, it is intended that all matter contained in the above description or shown in the accompanying drawings, can be interpreted as illustrative and not in a limiting sense.

INDUSTRIAL APPLICABILITY

Currently wheel changing and other maintenance to components of a rail car is performed with the aid of a number of pieces of heavy machinery such as cranes and jacks carried by wheel trucks or sidewinder vehicles. This equipment is expensive to produce, operate, and maintain. The equipment itself, as well as skilled personnel trained to use such equipment, represents a considerable investment.

A device or method that lifts a rail car and facilitates maintenance thereof by a limited number of people and pieces of equipment may be an advancement within the industry. The device described hereinabove is designed to lift fully loaded, double-stacked rail cars. A device capable of lifting fully loaded rail cars may present further advantages such as timesavings and increases in efficiency.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar references in the context of describing the invention (especially in the context of the following claims) are to be construed to cover both the singular and the plural, unless otherwise indicated herein or clearly contradicted by context. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the disclosure and does not pose a limitation on the scope of the disclosure unless otherwise claimed. No language in the specification should be construed as indicating any non-claimed element as essential to the practice of the disclosure.

Numerous modifications to the present disclosure will be apparent to those skilled in the art in view of the foregoing description. Preferred embodiments of this disclosure are described herein, including the best mode known to the inventors for carrying out the disclosure. It should be understood that the illustrated embodiments are exemplary only, and should not be taken as limiting the scope of the disclosure.

We claim:

1. A lifting device for lifting a rail car comprising:
a frame;
a load plate movably disposed on the frame;
a back plate movably disposed on the frame and coupled to the load plate;
a first actuator disposed on the frame and operatively coupled to the back plate;
at least one second actuator operatively coupled to the load plate; and
first and second side members disposed adjacent to and spaced apart from one another;
wherein the first actuator and the at least one second actuator produce forces in first and second directions;
wherein the first actuator and the at least one second actuator move the load plate in a substantially vertical direction; and
wherein the first and second side members are disposed on first and second sides of the load plate.

2. The lifting device of claim 1, wherein the frame further comprises:
first and second leg members disposed adjacent to and spaced apart from one another;
wherein the first and second leg members are disposed on the first and second sides of the load plate; and
wherein the back plate is movably attached to each of the first and second side members, and the load plate is operatively coupled to the first and second leg members through first and second arm members.

3. The lifting device of claim 1, wherein the load plate tilts independent of the back plate while the back plate partially transmits the force produced by the first actuator to the load plate.

4. The lifting device of claim 3, wherein at least one arm member is movably attached to a distal end of the load plate by at least one trunnion, the at least one trunnion allowing the at least one arm member to transmit the force produced by the at least one second actuator to the load plate while tilting such that the load plate maintains contact with the bottom surface of the rail car.

5. The lifting device of claim 1, further comprising:
at least one leg member; and
at least one arm member;
wherein the load plate is operatively coupled to the at least one leg member through the at least one arm member.

6. A lifting device for lifting a rail car comprising:
a frame;
a load plate movably disposed on the frame;
a back plate movably disposed on the frame and coupled to the load plate;
a first actuator disposed on the frame and operatively coupled to the back plate;
at least one second actuator operatively coupled to the load plate;
wherein the first actuator and the at least one second actuator produce forces in first and second directions;
wherein the first actuator and the at least one second actuator move the load plate in a substantially vertical direction;
at least one side member;
at least one leg member; and
at least one arm member;
wherein the load plate is operatively coupled to the at least one leg member through the at least one arm member;
wherein the back plate at least partially transmits the force produced by the first actuator to the load plate; and
wherein the at least one arm member at least partially transmits the force produced by the at least one second actuator load plate.

7. The lifting device of claim 6, the at least one arm member further comprising first and second arm members movably attached to the load plate; and
the at least one second actuator further comprising first and second horizontal actuators disposed alongside the at least one leg member; and
wherein the first and second arm members are operatively coupled to the respective first and second horizontal actuators.

8. The lifting device of claim 7, the at least one side member further comprising first and second side members disposed about the first actuator;

wherein the first actuator is a vertical actuator and the first actuator moves the back plate vertically along the first and second side members;

wherein the back plate at least partially transmits a load supported by the load plate to the frame; and wherein the first and second arm members at least partially transmit the load supported by the load plate to the at least leg member.

9. The lifting device of claim 7, the at least one leg member further comprising first and second leg members;

wherein the first and second arm members transmit the force produced by the first and second horizontal actuators to the load plate by hinging between the first and second leg members and a distal end of the load plate.

10. The lifting device of claim 9, wherein an angle formed between the first and second arm members and the respective first and second leg members when the load plate reaches an extended position transfers the load from the first and second arm members to a rail of the rail way.

11. A lifting device for lifting a rail car comprising:

a frame;

a load plate movably disposed on the frame;

a back plate movably disposed on the frame and coupled to the load plate;

a first actuator disposed on the frame and operatively coupled to the back plate;

at least one second actuator operatively coupled to the load plate;

wherein the first actuator and the at least one second actuator produce forces in first and second direction;

wherein the first actuator and the at least one second actuator move the load plate in a substantially vertical direction;

at least one side member;

at least one leg member; and at least one arm member;

wherein the load plate is operatively coupled to the at least one leg member through the at least one arm member;

at least one support pin mechanism disposed on the at least one side member; and wherein the at least one support pin mechanism at least partially supports the load plate after the load plate has been moved in the substantially vertical direction.

12. The lifting device of claim 11, further comprising:

at least one ladder of support ledges disposed on the back plate; and at least one support pin;

wherein the at least one support pin mechanism causes the at least one support pin to engage the respective at least one ladder of support ledges, and the back plate is held in an elevated position thereby; and wherein the load plate is supported when the back plate is held in the elevated position.

13. The lifting device of claim 12, wherein the at least one support pin mechanism further comprises at least one spring;

wherein the at least one spring provides consistent pressure such that the at least one support pin is continuously engaging the support ledges of the at least one ladder; and wherein the at least one support pin mechanism is capable of holding the back plate in more than one elevated position.

14. The lifting device of claim 13, wherein the at least one support pin mechanism further comprises at least one third actuator, the at least one third actuator operatively coupled to the at least one support pin such that operation of the at least one third actuator disengages the at least one support pin from the respective support ledge.

* * * * *